US007070079B2

(12) United States Patent
Smolinski et al.

(10) Patent No.: US 7,070,079 B2
(45) Date of Patent: Jul. 4, 2006

(54) NO-MAR TIP FOR FASTENING TOOL

(75) Inventors: Darek Smolinski, Chicago, IL (US); Allan F. Miller, Lindenhurst, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/794,221

(22) Filed: Mar. 5, 2004

(65) Prior Publication Data

US 2005/0194421 A1 Sep. 8, 2005

(51) Int. Cl.
*B25C 1/04* (2006.01)

(52) U.S. Cl. ..... 227/8; 227/142; 227/156

(58) Field of Classification Search ..... 227/120, 227/8, 130, 148, 156, 142; D8/68, 69, 61
See application file for complete search history.

(56) References Cited

U.S. PATENT DOCUMENTS 3,762,620 A 10/1973 Geist
4,211,353 A 7/1980 Aunis
4,581,964 A * 4/1986 Takatsuru ..... 81/464
4,767,043 A * 8/1988 Canlas, Jr. ..... 227/8
5,509,489 A 4/1996 Lower, Jr.
5,649,661 A * 7/1997 Masuno et al. ..... 227/8
5,685,473 A * 11/1997 Shkolnikov et al. ..... 227/8
5,839,638 A 11/1998 Ronn
6,158,643 A * 12/2000 Phillips ..... 227/130
6,186,386 B1 * 2/2001 Canlas et al. ..... 227/142
D461,694 S * 8/2002 Buck ..... D8/68
6,454,151 B1 * 9/2002 Wang-Kuan ..... 227/8

OTHER PUBLICATIONS

JLC Magazine, Jun. 2002, disclosing DeWalt Model D51275.*
Porter Cable Model No. FN250B Instruction manual, 2001.*
Campbell Hausfeld Model No. NB3565 Instruction manual, Apr. 1998.*
Makita Publication (Model AF632), Jan. 2001.*

* cited by examiner

*Primary Examiner*—Scott A. Smith
(74) *Attorney, Agent, or Firm*—Lisa M. Soltis; Mark W. Croll; Beem Patent Law Firm

(57) ABSTRACT

A novel work contact or no-mar tip for mounting to a drive probe of a fastening tool having a driver blade for driving a fastener into a workpiece is provided having a pair of wings having resilient contact surfaces for contacting the workpiece, the wings forming a channel for the fastener while allowing for visually locating the position where the fastener will be driven into the workpiece.

19 Claims, 3 Drawing Sheets

NO-MAR TIP FOR FASTENING TOOL

BACKGROUND OF THE INVENTION

1. Field of the Invention

The present invention is directed to a work contact or no-mar tip for use with a fastening tool.

2. Description of the Related Art

Fastening tools typically include a drive probe for contacting a workpiece and for enabling the firing of the tool, see for example U.S. Pat. No. 6,012,622, assigned to the assignee of this application. U.S. Pat. No. 4,767,043 discloses a work contacting block connected to a guide rod. U.S. Pat. No. 6,371,348 discloses a work contact element connected to a lower structure or metal rod. However, work contact elements have been so large or obstructive of the view of the workpiece that they make it difficult to determine where a fastener will be driven. Some work contact elements mar the surface of the workpiece. Imprecision and marring are problems when driving fasteners into trim or molding for finishing applications, wherein appearance is important.

What is needed is a work contact or no-mar tip for a fastening tool that solves one or more problems of the prior art.

BRIEF SUMMARY OF THE INVENTION

A novel work contact or no-mar tip for mounting to a drive probe of a fastening tool having a driver blade for driving a fastener into a workpiece is provided having a pair of wings having resilient contact surfaces for contacting the workpiece, the wings forming a channel for the fastener while allowing for visually locating the position where the fastener will be driven into the workpiece. In a preferred embodiment, a nose of the tool fits within the channel of the work contact tip so that the channel receives the driver blade, which is in the nose.

In one embodiment, a work contact or no-mar tip for mounting to a drive probe of a fastening tool having a driver blade for driving a pin into a workpiece is provided having a generally horseshoe shaped member having a channel for the pin while allowing for visually locating the position where the pin will be driven into the workpiece.

A novel fastening tool is provided having a driver blade for driving a fastener into a workpiece, a power source for driving the driver blade, a housing enclosing the driver blade, the housing including a nosepiece for accepting the fastener and for axially guiding the driver blade in a driving direction toward impact with the fastener, a wire drive probe extending in the driving direction from the housing to a driving end, and a resilient work contact tip mounted to the driving end of the drive probe, the work contact tip having a body and a pair of wings extending therefrom, the wings having contact surfaces for contacting the workpiece, the wings forming a channel for the fastener while allowing for visually locating the position where the fastener will be driven into the workpiece.

DETAILED DESCRIPTION OF THE INVENTION

Figure 1:
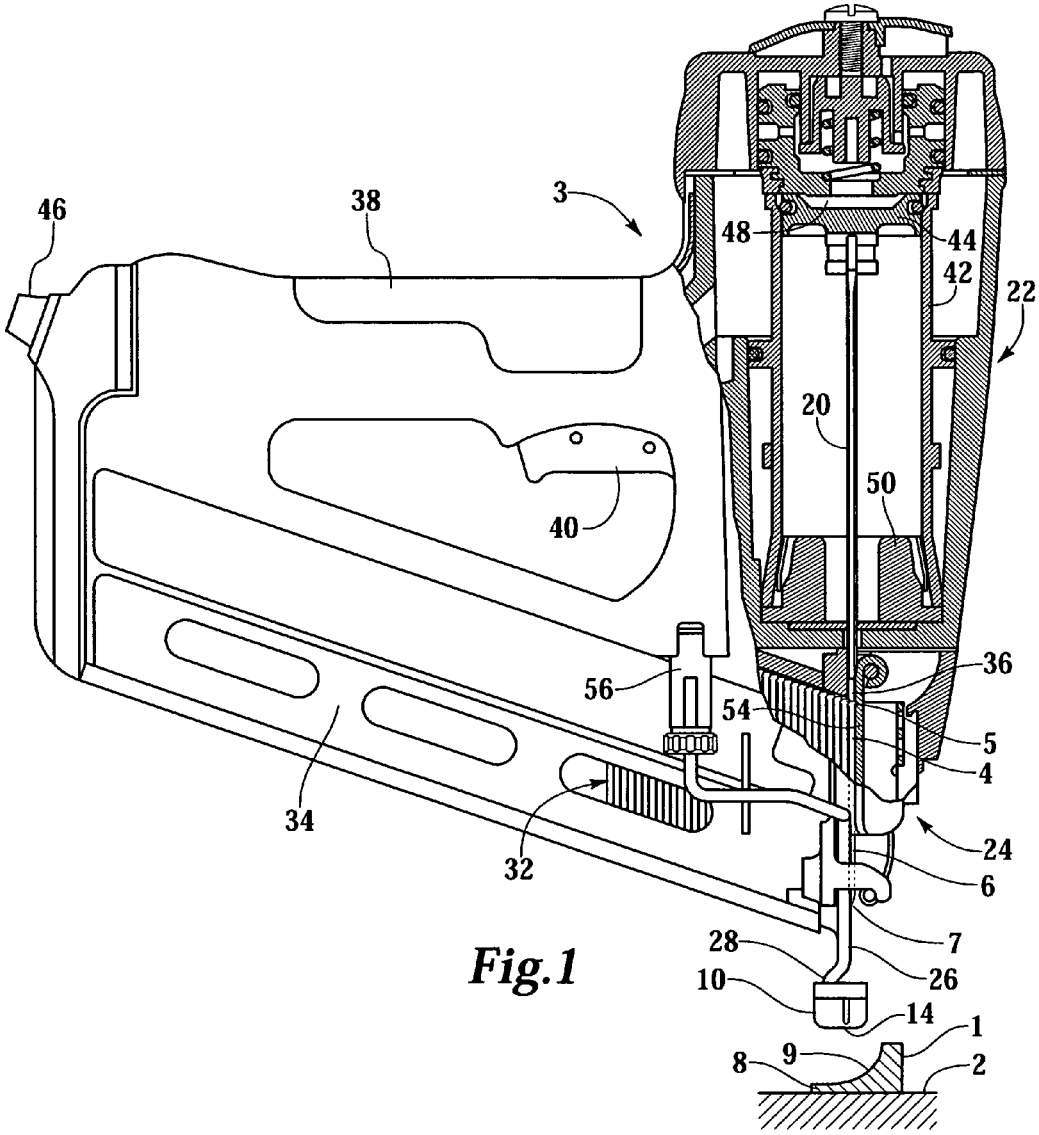
FIG. 1 is partial side sectional view of a tool having a work contact or no-mar tip of the present invention.
Figure 3:
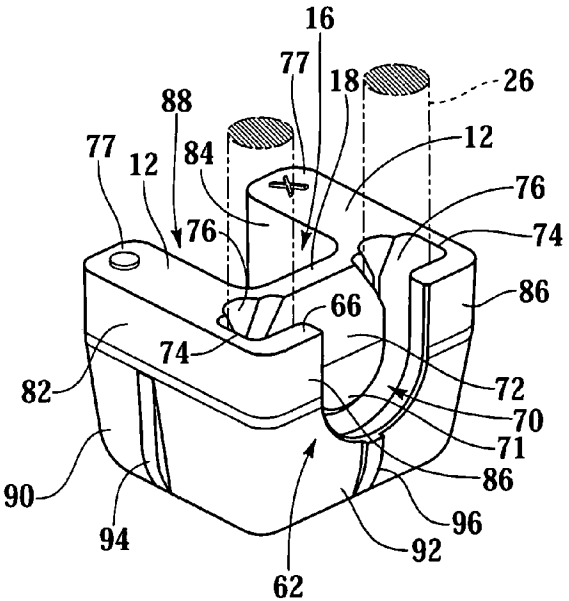
FIG. 3 is a perspective view of the work contact tip mounted to a drive probe.
Figure 4:
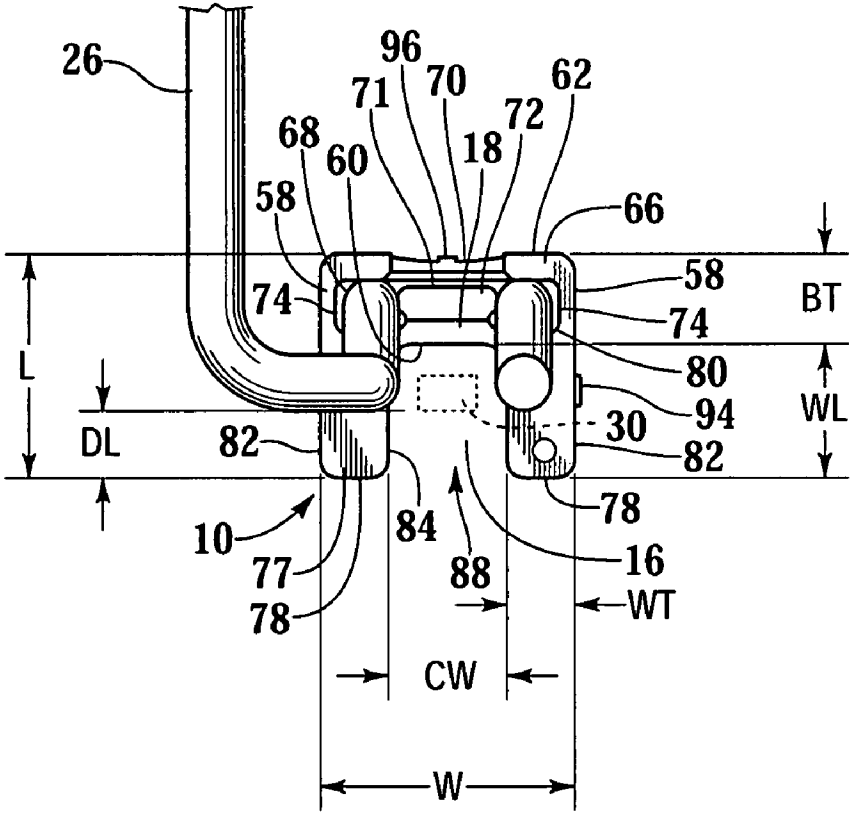
FIG. 4 is an elevation view of the work contact tip and the drive probe.

Referring to FIGS. 1, 3 and 4, a work contact or no-mar tip 10 for mounting to a drive probe 26 of a fastening tool 3 with a driver blade 20 for driving a fastener 4 into a workpiece 1 is shown having a pair of wings 12 having resilient contact surfaces 14 for contacting workpiece 1, wherein wings 12 form a channel 16 for fastener 4 while allowing for visually locating the position 30 where fastener 4 will be driven into workpiece 1. In one embodiment, work contact tip 10 includes a body 18, and wings 12 extend from body 18.

Fastening Tool

Figure 2:
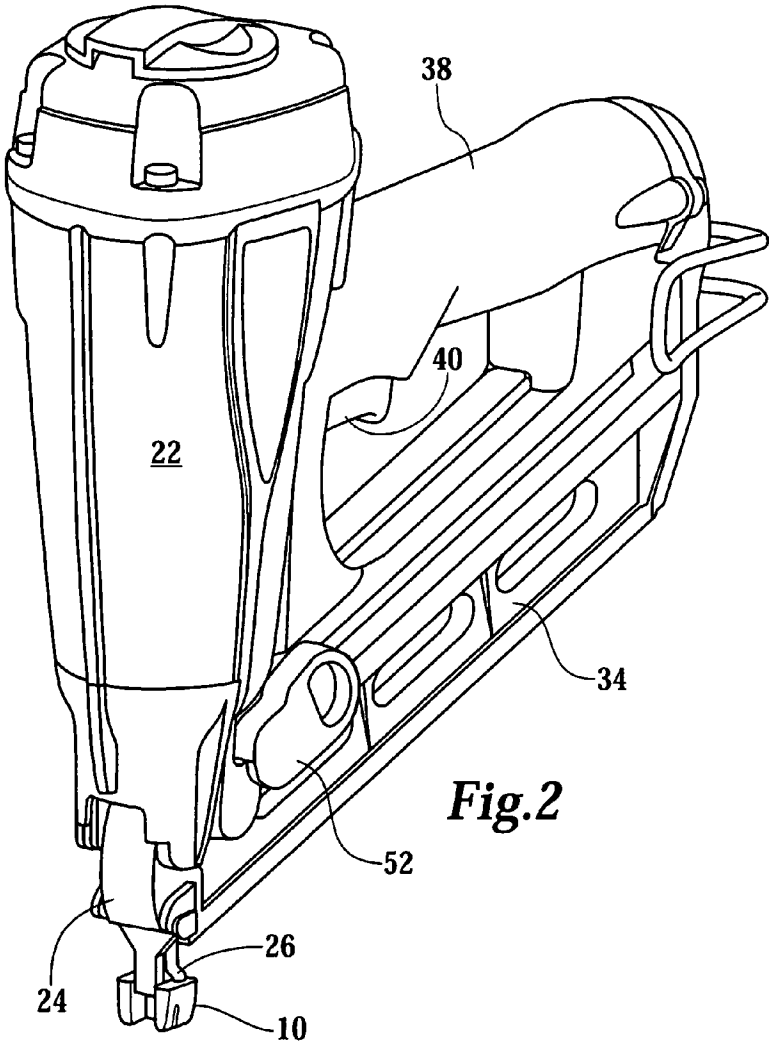
FIG. 2 is a perspective view of the tool and the work contact tip.

Turning to FIGS. 1, 2 and 4, fastening tool 3 includes a driver blade 20 for driving a fastener 4 into workpiece 1, a power source, such as compressed air, for driving driver blade 20, a housing 22 enclosing driver blade 20, housing 22 having a nosepiece 24 for accepting fastener 4 and for axially guiding driver blade 20 in a driving direction toward impact with fastener 4, a wire drive probe 26 extending in the driving direction from housing 22 to a driving end 28, a resilient work contact tip 10 mounted to driving end 28 of drive probe 26, work contact tip 10 having a body 18 and a pair of wings 12 extending from body 18, the wings 12 having resilient contact surfaces 14 for contacting workpiece 1, wings 12 forming a channel 16 for driver blade 20 and fastener 4 while allowing for visually locating the position 30 where fastener 4 will be driven into workpiece 1.

In a preferred embodiment, tool 3 is used for driving pins 4 for fastening a workpiece 1, such as molding or trim having a ledge 8 as shown in FIG. 1, to a substrate 2, such as a wall or a cabinet. Fasteners 4 may be rectangular or round. In a preferred embodiment particularly suited for trim applications, each fastener 4 has a generally rectangular cross section corresponding generally to the cross section of driver blade 20. Each fastener 4 has a generally rectangular head 5, a generally rectangular shaft 6 and a point 7. A plurality of fasteners 4 can be coupled together in a strip 32 and placed in a magazine 34 of tool 3, as shown in FIG. 1. The fastener 4 that is to be driven by driver blade 20 is positioned within a channel 36 within nosepiece 24. Channel 36 acts to guide driver blade 20 and fastener 4 in the driving direction toward workpiece 1. A nose is located at the driving end of nosepiece 24, wherein the nose fits within channel 16 of work contact tip 10, as shown in FIG. 3, so that as driver blade 20 drives fastener 4, driver blade 20 remains within the nose.

Housing 22 of tool 3 includes a handle 38 depending generally from a trailing end of housing 22 for an operator to hold tool 3. A trigger 40 is mounted to handle 38 for actuating tool 3. A cylinder 42 is located within housing 22, with a piston 44 being within cylinder 42. Driver blade 20 is coupled to piston 44 so that when piston 44 is driven in a driving direction through cylinder 42, so is driver blade 20. An example of a driver blade that can be used in tool 3 is disclosed in the commonly assigned, co-pending patent application having Attorney Docket # 14262, filed contemporaneously herewith, the disclosure of which is incorporated herein by reference.

A power source, such as pneumatic power, gas combustion, or explosive powder is used to drive piston 44 and driver blade 20 in the driving direction toward fastener 4. In one embodiment, tool 3 includes an air connection 46 for connecting to a compressed air source (not shown), which feeds into a chamber 48 in the trailing direction of piston 44. When trigger 40 is pulled by an operator, air pressure is increased in chamber 48, which drives piston 44 toward fastener 4. Tool 3 can also include a buffer 50 generally at the driving end of cylinder 42 to protect piston 44 and tool 3 from damage due to high speed impact.

Preferably, tool 3 includes a magazine 34 for feeding a strip 32 of fasteners 4 into channel 36. Tool 3 can also include a follower 52 which biases strip 32 toward channel 36, so that when one fastener 4 is driven, the follower biases the next fastener 4 into channel 36. Tool 3 also includes a front plate 54, which frames part of channel 36, and preferably can be temporarily removed, such as by the hinged connection to housing 22 shown in FIG. 1, so that channel 36 can be opened to perform maintenance, such as removing debris from channel 36.

Continuing with FIG. 1, tool 3 also includes drive probe 26 extending in the driving direction from housing 22. Drive probe 26 is operationally connected to a triggering mechanism (not shown) via a link 56, so that tool 3 cannot be fired without drive probe 26 and link 56 being pushed in the trailing direction by workpiece 1, enabling actuation of tool 3. In one embodiment, drive probe 26 is generally U-shaped at driving end 28, as seen in FIG. 3. Work contact tip 10 is mounted to driving end 28 of drive probe 26 to prevent drive probe 26 from marring the surface of workpiece 1.

Work Contact or No-Mar Tip

Work contact or no-mar tip 10 includes a pair of wings 12, and in a preferred embodiment a body 18 having ends 58, wherein wings 12 extend from generally opposite ends 58 of body 18, as shown in FIG. 4.

Figure 5:
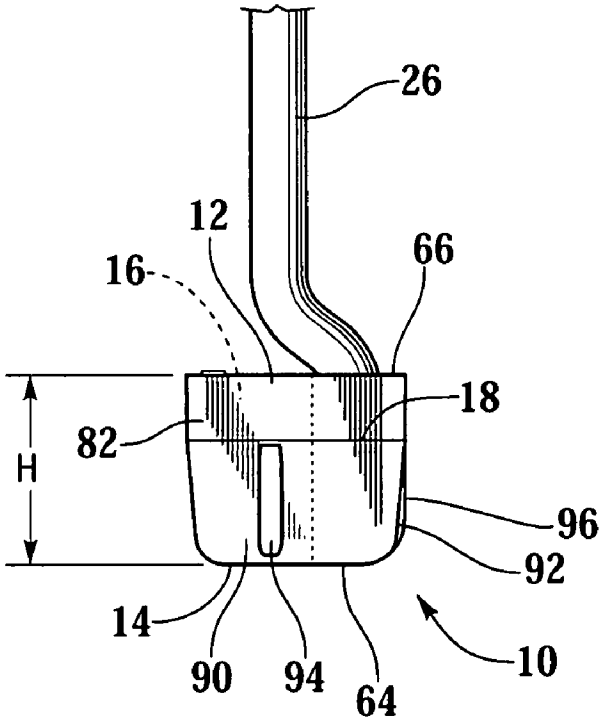
FIG. 5 is a side view of the work contact tip and the drive probe.

Turning to FIGS. 3–5, in one embodiment, body 18 of work contact tip 10 includes ends 58, front side 60, rear side 62, contact surface 64, and trailing surface 66. Wings 12 are connected to front side 60 of body 18 at ends 58. Front side 60 of body 18 also frames channel 16 along with wings 12, as shown in FIG. 3. Body 18 can also include means for connecting to drive probe 26, such as a recess 68. The means for connecting to drive probe 26 can also be included with one or both of wings 12.

In one embodiment, recess 68 is in trailing surface 66 of body 18 and recess 68 includes an opening 70 in body 18, preferably in rear side 62 of body 18, for more easily mounting work contact tip 10 to drive probe 26. Preferably, recess 68 and opening 70 are generally U-shaped to complement the U-shape of drive probe 26. A ledge 71 can also be included in recess 68 to retain drive probe 26 in recess 68. In one embodiment, ledge 71 includes a ramp 72 for easily mounting to drive probe 26 so that drive probe 26 can slide along ramp 72 into recess 68. In one embodiment, the ends 74 of recess 68 include chamfers 76 to allow work contact tip 10 to rock or pivot in a side-to-side manner with respect to drive probe 26 so that tool 3 can be used in tight spaces, such as corners, where tool 3 cannot be oriented completely vertically.

The distance between the ends of wings 12 and the axis of blade 20 is important, as described below. In one embodiment, body 18 has a thickness BT that is between about 25% and about 50%, preferably between about 35% and about 45%, still more preferably about 40% of the total length L of work contact tip 10. Body 18 also has a width that is essentially the entire width W of work contact tip 10.

Continuing with FIGS. 3 and 4, wings 12 include contact surfaces 14 for contacting workpiece 1, trailing surfaces 77 facing generally toward nosepiece 24, front ends 78, rear ends 80 connected to body 18, outside surfaces 82 and inside surfaces 84. Channel 16 is formed between wings 12 for driver blade 20 and fastener 4. Channel 16 also allows for visually locating the position 30 where fastener 4 will be driven.

Wings 12 have a predetermined length WL selected for precision placement of fastener 4 in workpiece 1. Length WL of wings 12 is selected so that a desired length DL between front ends 78 of wings 12 and position 30 where fastener 4 will be driven is achieved. The length DL from front ends 78 of wings 12 to fastener position 30 is selected so that wing ends 78 can be pushed against a surface, such as a wall 9 of a ledge shown in FIG. 1, and fastener 4 will be driven close to the surface. The selected length DL allows an operator to easily place a fastener 4 relative to the surface, by simply pushing wing ends 78 against the surface and actuating tool 3.

In one embodiment, length WL of wings is between about 50% and about 75%, preferably between about 55% and about 65%, still more preferably about 60% of the total length L of work contact tip 10. The length DL between wing ends 78 and fastener position 30 can be between about 20% and about 40%, preferably between about 25% and about 35%, still more preferably about 30% of the total length L of work contact tip 10, and length DL can be between about 25% and about 75%, preferably between about 40% and about 60%, still more preferably about 50% of the length WL of wings 12.

Each wing 12 can have a thickness WT of between about 15% and about 35%, preferably between about 25% and about 30%, still more preferably about 27.5% of the total width W of work contact tip 10, so that channel 16 has a width CW of between about 30% and about 70%, preferably between about 40% and about 50%, still more preferably about 45% of the total width W of work contact tip 10.

Turning to FIG. 4, in one embodiment, work contact tip 10 has a width W of between about ½ inch and about 1 inch, preferably between about 0.6 inch and about 0.8 inch, still more preferably about 0.7 inch, a length L of between about 0.4 inch and about 1 inch, preferably between about ½ inch and about 0.7 inch, still more preferably about 0.6 inch, and work contact tip 10 has a height H of between about ¼ inch and about ¾ inch, preferably between about 0.4 inch and about 0.6 inch, still more preferably about ½ inch. Body 18 can have a thickness BT of between about 0.1 inch and about 0.35 inch, preferably about ¼ inch. Wings 12 can have a length WL of between about ¼ inch and about ½ inch, preferably about 0.35 inch, and wings 12 can each have a thickness of between about 0.1 inch and about 0.3 inch, preferably about 0.2 inch. The length DL between wing ends 78 and fastener position 30 can be between about 0.05 inch and about 0.35 inch, preferably between about 0.1 inch and about 0.3 inch, still more preferably about 0.2 inch.

In one embodiment, wings 12 can spread outwardly away from channel 16 because work contact tip 10 is made from a resilient material. When wings 12 spread outwardly, outside portions 86 of body rear side 62 pinch together toward opening 70 so that drive probe 26 is tightly held within recess 68 when tool 3 is in use, preventing work contact tip 10 from becoming disengaged with drive probe 26.

Turning to FIGS. 3 and 4, in a preferred embodiment, work contact tip 10 is a generally horseshoe shaped member having a cross section that is generally U-shaped, as is best seen in FIGS. 3 and 4, having a channel 16 surrounding a path for pin 4 and driver blade 20, channel 16 allows for visually locating the position 30 where pin 4 will be driven into workpiece 1, wherein the member is mountable to drive probe 26. The position 30 where fastener 4 will be driven can be visually located because work contact tip 10 includes a window 88 between wing ends 78 so that an operator can look into channel 16 and visually determine where fastener 4 will be driven into workpiece 1.

In one embodiment, a lower portion 90 of each wing 12 and a lower portion 92 of body 18 are tapered toward contact surfaces 14, 64 so that work contact tip 10 obstructs as little of workpiece 1 as possible. In one embodiment, lower portions 90, 92 are tapered toward contact surfaces 14, 64 at an angle of between about 1° and about 10°, preferably about 5°.

Work contact tip 10 can also include indicia 94, 96 to precisely locate the position 30 where fastener 4 will be driven into workpiece 1. In one embodiment, each wing 12 includes an index 94, preferably on outside surfaces 82, and rear side 62 of body 18 includes an index 96. An operator can use wing indicia 94 to precisely located the position 30 of fastener 4 along the length L of work contact tip 10, and the operator can use rear side index 96 to precisely locate the position 30 of fastener 4 along the width W of work contact tip 10, so that the operator can precisely locate the exact position 30 of fastener 4 before firing tool 3.

Because the final appearance is of workpiece 1 is particularly important for finishing applications, such as fastening molding or trim, work contact tip 10 preferably is made from a soft, resilient material so that when properly used there is little or no visibly noticeable impact mark or marring of suitable workpiece 1. The material should allow for a predetermined amount of friction sufficient to prevent slippage of work contact tip 10 when engaged with workpiece 1. Preferably, work contact tip 10 is made from rubber, or another highly resilient material. The material also should be selected so that work contact tip 10 is worn down by workpiece 1, and not the other way around, wherein workpiece 1 is worn away by work contact tip 10. The material of work contact tip 10 is preferably inexpensive and easily replaceable.

The work contact or no-mar tip of the present invention advantageously allows an operator of the fastening tool to easily locate and position the location where the fastener will be driven without marring the workpiece. The resilient work contact tip includes a pair of wings having contact surfaces, wherein the wings form a channel for the drive probe and the fastener, wherein the channel allows an operator to visually locate where the fastener will be driven into the workpiece.

While the foregoing written description of the invention enables one of ordinary skill to make and use what is considered presently to be the best mode thereof, those of ordinary skill will understand and appreciate the existence of variations, combinations, and equivalents of the specific exemplary embodiment herein. The invention should therefore not be limited by the above described embodiment, but by all embodiments within the scope and spirit of the invention.

What is claimed is:

1. A one piece work contact tip for mounting to a U-shape drive probe of a fastening tool having a driver blade for driving a fastener into a workpiece, said work contact tip comprising:

a body including ends, a front side, a rear side opposite said front side, a work contact surface, and a trailing surface opposite said work contact surface;

a pair of wins connected to said front side of said body at said ends;

said pair of wings having resilient contact surfaces for contacting said workpiece, said wings forming a channel for said fastener and for visually locating the position where said fastener will be driven into said workpiece;

a recess located in said trailing surface of said body for retaining said drive probe, and thereby mounting said work contact tip to said drive probe, said recess being generally U-shaped to complement and receive the U-shape of said drive probe.

2. A work contact tip according to claim 1, further comprising a ledge in said recess to retain said drive probe in said recess.

3. A fastener driving tool according to claim 2 wherein said ledge includes a ramp for allowing said drive probe to slide along said ramp into said recess and wherein ends of the recess adjacent said trailing surface include chamfers to allow said work contact tip to pivot in a side-to-side manner with respect to said drive probe so that said tool can be used in tight spaces, such as corners, where said tool cannot be oriented completely vertically.

4. A work contact tip according to claim 1, wherein said recess has chamfered ends that allow said work contact tip to pivot during operation with respect to said drive probe.

5. A work contact tip according to claim 1, wherein said channel of said work contact tip is configured to receive a nose of said fastening tool.

6. A work contact tip according to claim 1, wherein at least one of said wings includes an index for the position where said fastener will be driven into said workpiece.

7. A work contact tip according to claim 1, wherein at least lower portions of said wings are tapered toward said contact surfaces.

8. A work contact tip according to claim 1, further comprising means for connecting said pair of wings to said drive probe.

9. A fastener driving tool according to claim 1 wherein said body has a thickness that is between 25% and about 50% of a total length of said work contact tip and width that is essentially the entire width of said work contact tip.

10. A fastener driving tool according to claim 1 wherein said wings include contact surfaces for contacting said workpiece, trailing surfaces facing generally opposite said contact surfaces, rear ends connected to said body, front ends opposite said rear ends, outside surfaces and inside surfaces, and wherein said wings have a predetermined length between said front ends and a position where a fastener will be driven selected so that said wing ends can be pushed against a surface, and a fastener will be driven close to the surface.

11. A fastener driving tool according to claim 10 wherein said length of said wings is between about 50% and about 75% of a total length of the work contact tip, a length between said wing front ends and said fastener position is between about 20% and about 40% of the total length of the work contact tip and between about 25% and about 75% of the length of the wings.

12. A fastener driving tool according to claim 1 wherein each wing has a thickness of between about 15% and about 35% of a total width of the work contact tip, so that the channel has a width of between about 30% and about 70%, of the total width of the work contact tip.

13. A fastener driving tool according to claim 1 wherein the work contact tip 10 has a width of between about ½ inch and about 1 inch, a length of between about 0.4 inch and about 1 inch, and a height of between about ¼ inch and about ¾ inch, wherein said body has a thickness of between about 0.1 inch and about 0.35 inch, wherein said wings have a length of between about ¼ inch and about ½ inch, and a thickness of between about 0.1 inch and about 0.3 inch, and wherein a length between the wing front ends and a desired fastener position is between about 0.05 inch and about 0.35 inch.

14. A fastener driving tool according to claim 1 wherein said work contact tip is made from a resilient material such that said wings can spread apart and away from said channel whereby outside portions of said body rear side pinch together so that the drive probe is tight held within said recess, substantially preventing said work contact tip from becoming disengaged with drive probe.

15. In combination, a drive probe of a fastening tool having a driver blade for driving a pin into a workpiece, and a work contact tip mounted to said drive probe, wherein said work contact tip comprises: a generally horseshoe shaped member having a body including ends, a front side, a rear side opposite said front side, a work contact surface, and a trailing surface opposite said work contact surface;

a pair of wings connected to said front side of said body at said ends;

said pair of wings having resilient contact surfaces for contacting said workpiece, said wings forming a channel for said pin and for visually locating the position where said pin will be driven into said workpiece, while allowing for visually locating the position where said pin will be driven into said workpiece, and wherein said drive probe is oriented perpendicular to the work surface.

16. A combination according to claim 9, wherein said channel faces in a forward direction relative to said tool.

17. A fastening tool comprising:

a driver blade for driving a fastener into a workpiece;

a power source for driving said driver blade;

a housing enclosing said driver blade, said housing including a nosepiece for accepting said fastener and for axially guiding said driver blade in a driving direction toward impact with said fastener;

a wire drive probe extending in the driving direction from said housing to a driving end; and a resilient work contact tip mounted to said driving end of said drive probe, said work contact tip having a body body including ends, a front side, a rear side opposite said front side, a work contact surface, and a trailing surface opposite said work contact surface;

a pair of wings extending from said front side of said body at said ends;

said pair of wings having resilient contact surfaces for contacting said workpiece, said wings forming a channel for said fastener while allowing for visually locating the position where said fastener will be driven into said workpiece.

18. A fastener driving tool according to claim 17, wherein said wings have ends and a predetermined length selected for positioning of said fastener at a predetermined distance from said ends of said wings.

19. A fastener driving tool according to claim 17, wherein said work contact tip further comprises a recess in said trailing surface for retaining said drive probe, and thereby mounting said work contact tip to said drive probe, said recess being generally U-shaped to complement and receive the U-shape of drive probe.

* * * * *